US010316841B2

(12) United States Patent
Ikeda et al.

(10) Patent No.: US 10,316,841 B2
(45) Date of Patent: Jun. 11, 2019

(54) COMPRESSOR, OIL-FREE SCREW COMPRESSOR, AND METHOD OF MANUFACTURING CASING USED THEREFOR

(71) Applicant: Hitachi Industrial Equipment Systems Co., Ltd., Chiyoda-ku, Tokyo (JP)

(72) Inventors: Yukiko Ikeda, Tokyo (JP); Masakatsu Okaya, Tokyo (JP); Yuuichi Yanagase, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 734 days.

(21) Appl. No.: 14/921,538

(22) Filed: Oct. 23, 2015

(65) Prior Publication Data

US 2016/0115950 A1 Apr. 28, 2016

(30) Foreign Application Priority Data

Oct. 27, 2014 (JP) ..... 2014-217888

(51) Int. Cl.
*F04C 18/16* (2006.01)
*C23C 8/34* (2006.01)
*F01C 21/10* (2006.01)

(52) U.S. Cl.
CPC ..... *F04C 18/16* (2013.01); *C23C 8/34* (2013.01); *F01C 21/10* (2013.01);
(Continued)

(58) Field of Classification Search
None
See application file for complete search history.

(56) References Cited

U.S. PATENT DOCUMENTS 4,187,064 A * 2/1980 Wheeler ..... F01C 1/3562 418/186
4,466,785 A * 8/1984 Biswas ..... B24B 19/08 29/888.025

(Continued)

FOREIGN PATENT DOCUMENTS

CN 1399074 A 2/2003
CN 1912393 A 2/2007

(Continued)

OTHER PUBLICATIONS

H. Ishii, About Nitrotec Process, Industrial Heating: Japan industrial Furnace Manufacturers Association, 1985, vol. 22, No. 6, pp. 39-44.

(Continued)

*Primary Examiner* — Veronica F Faison
(74) *Attorney, Agent, or Firm* — Crowell & Moring LLP

(57) ABSTRACT

An object of the invention is to provide a compressor that includes a corrosion-resistant film formed on the surface of a casing having a complicated shape. A compressor pumps gas in a compression chamber formed by a casing, the casing is made of cast iron, and a layer made of a mixture of iron nitride and a compound of iron, nitrogen, and carbon and an oxide layer made of triiron tetraoxide are formed on the surface of the casing. Accordingly, since the corrosion resistance of the casing, which includes a film formed by a gas soft-nitriding treatment and an oxidation treatment, is improved, the generation of rust is suppressed. Therefore, it is possible to provide a compressor in which galling or sticking caused by rust occurs less.

8 Claims, 5 Drawing Sheets

(52) U.S. Cl.
CPC ..... *F04C 2230/91* (2013.01); *F04C 2240/30* (2013.01); *F04C 2280/04* (2013.01); *F05C 2201/0439* (2013.01); *F05C 2203/08* (2013.01); *F05C 2203/083* (2013.01); *F05C 2253/24* (2013.01)

(56) References Cited

U.S. PATENT DOCUMENTS

| | | | | |
|---|---|---|---|---|
| 4,944,663 | A | 7/1990 | Iizuka et al. | |
| 5,364,250 | A * | 11/1994 | Aoki | F01C 21/08 29/889.23 |
| 6,506,037 | B1 | 1/2003 | Bush et al. | |
| 6,884,049 | B2 | 4/2005 | Hida et al. | |
| 6,988,877 | B2 | 1/2006 | Bush et al. | |
| 8,801,412 | B2 | 8/2014 | Ikeda et al. | |
| 2003/0108446 | A1 * | 6/2003 | Hida | C21D 5/00 418/201.1 |
| 2013/0000787 | A1 | 1/2013 | Holly et al. | |
| 2014/0060704 | A1 | 3/2014 | Sugai et al. | |
| 2014/0060983 | A1 | 3/2014 | Sugai et al. | |
| 2014/0322058 | A1 * | 10/2014 | Ikeda | F04C 18/084 418/179 |

FOREIGN PATENT DOCUMENTS

| | | | |
|---|---|---|---|
| CN | 101096986 | A | 1/2008 |
| CN | 103671639 | A | 3/2014 |
| JP | 61-14494 | A | 1/1986 |
| JP | 2-301694 | A | 12/1990 |
| JP | 6-317277 | A | 11/1994 |
| JP | 9-228972 | A | 9/1997 |
| JP | 2003-184769 | A | 7/2003 |
| JP | 2004-502095 | A | 1/2004 |
| JP | 2005-83235 | A | 3/2005 |
| JP | 2005-515067 | A | 5/2005 |
| JP | 2009-144683 | A | 7/2009 |
| JP | 5416072 | B2 | 2/2014 |
| JP | 2014-47406 | A | 3/2014 |
| WO | WO 91/04351 | A1 | 4/1991 |
| WO | WO 03/061852 | A1 | 7/2003 |

OTHER PUBLICATIONS

Japanese-language Office Action issued in counterpart Japanese Application No. 2014-217888 dated Jul. 24, 2018 with unverified English translation (five pages).

Chinese-language Office Action issued in counterpart Chinese Application No. 201510706537.4 dated Jun. 15, 2017 with English translation (15 pages).

Ziwen X., "Screw Compressor—Theory, Design and Application", Aug. 2000, pp. 202-204, 207, vol. 1, Issue 1-5, China Machine Press, including English translation (27 pages).

* cited by examiner

F I G. 5
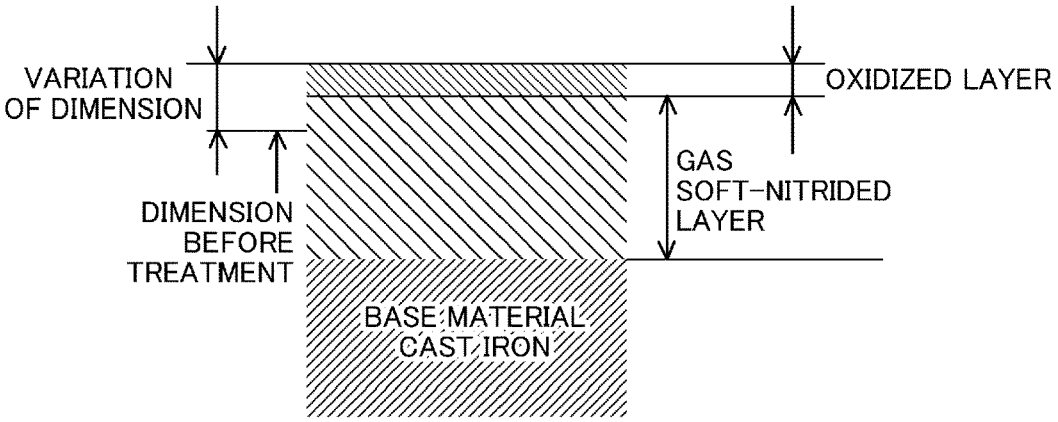
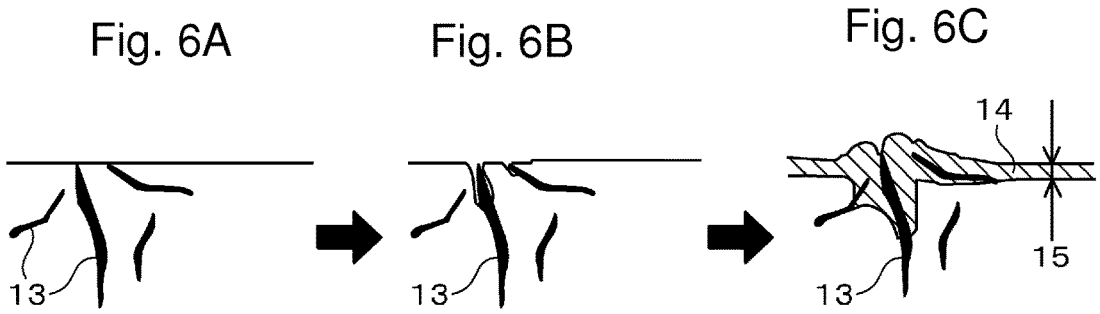
F I G. 7
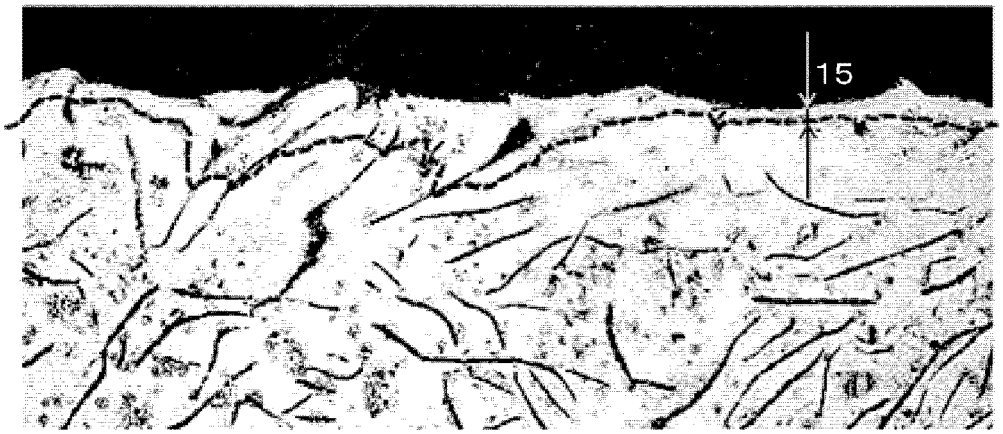

COMPRESSOR, OIL-FREE SCREW COMPRESSOR, AND METHOD OF MANUFACTURING CASING USED THEREFOR

TECHNICAL FIELD

The present invention relates to a compressor that pumps gas in a compression chamber and a casing of the compressor, and more particularly, to a surface treatment that improves the corrosion resistance of the inside of a compression chamber and an air flow passage of a casing.

BACKGROUND ART

A compressor is a machine that pumps gas in a compression chamber formed by a casing, and there are a screw compressor that pumps gas by the rotational motion of a rotor, a reciprocating compressor that pumps gas by the reciprocating motion of a piston, a scroll compressor that pumps gas by the turning motion of a spiral tooth-shaped member, and the like as the type of the compressor. A screw compressor will be described below as an example.

The screw compressor has a structure in which a pair of a male rotor and a female rotor rotate while meshing with each other in a compression chamber formed by a suction-side casing and a discharge-side casing and reduce the volume of a space formed between both the rotors and the volume of a space formed by the casing and the rotors while moving in an axial direction, thereby compressing fluid present in the spaces.

Moreover, as the screw compressor, there are an oil-cooled screw compressor in which oil is supplied into a casing as fluid and an oil-free screw compressor in which oil is not supplied.

The oil-cooled screw compressor is adapted so that a male rotor and a female rotor rotate while coming into contact with each other through an oil film. The oil-cooled screw compressor can prevent seizure between the rotors by reducing frictional heat, which is generated by the rotation of the rotors, with oil. Since oil mist is mixed in compressed air in the oil-cooled screw compressor, the oil-cooled screw compressor is not suitable for fields that require clean air, such as a food industry and an industry related with a semiconductor.

Meanwhile, since oil is not supplied at all in the oil-free screw compressor, the oil-free screw compressor can provide clean air but does not include seal using oil. Accordingly, the rotors rotate while both the rotors do not come into contact with each other and the rotors do not come into contact with the casing so that seizure is not caused between the rotors. For this purpose, timing gears are mounted on end portions of shafts of the rotors in order to apply torque to the rotors in the oil-free screw compressor. Accordingly, the structure of the oil-free screw compressor is more complicated than the structure of the oil-cooled screw compressor.

Further, since the rotors do not come into contact with each other in the oil-free screw compressor, there is a possibility that compressed air may flow backward to the suction side from a gap between both the rotors, a gap between the rotor and the casing, or the like and may adversely affect the performance of the screw compressor. For this reason, for the improvement of performance such as volumetric efficiency, in the oil-free screw compressor, a very small gap needs to be formed between both the rotors and between the rotors and the casing while both the rotors do not come into contact with each other and the rotors and the casing do not come into contact with each other. However, since the compressor actually has thermal expansion, machining errors, and the like, the non-contact between the rotors and the non-contact between the rotors and the casing cannot be completely achieved. Accordingly, a solid lubrication film is formed on the surface of the rotor as described in JP 5416072 B1 (Patent Document 1).

In addition, a factor affecting the reliability of the oil-free screw compressor is the generation of rust. Since the material of the rotor is stainless steel and a solid lubrication film is formed on the rotor, the generation of rust on the rotor hardly occurs as it is. However, since the material of the casing is cast iron, rust is easily generated on the casing.

As a treatment to be applied to the casing, there is an example for forming an abrasion-resistant coating disclosed in JP 2004-502095 W (Patent Document 2). An object of Patent Document 2 is to apply an abrasion-resistant coating to the rotors or the casing or both the rotors and the casing to suppress the leakage of compressed air. An example in which a nitride coating is used as the coating is disclosed.

Further, JP 2005-83235 A (Patent Document 3) discloses a scroll compressor of which the sliding surface is coated with metal nitride. An object of Patent Document 3 is also to ensure the abrasion resistance of a sliding portion and to improve sealability.

CITATION LIST

Patent Document

Patent Document 1: JP 5416072 B2
Patent Document 2: JP 2004-502095 A
Patent Document 3: JP 2005-83235 A

SUMMARY OF THE INVENTION

Problems to be Solved by the Invention

Like the oil-cooled screw compressor, an oil-free compressor does not include a medium for cooling air of which the temperature has risen by adiabatic compression. Accordingly, both a temperature difference and a pressure difference between the suction side and the discharge side of the rotor are increased in the case of, for example, a screw compressor. Air, which is sucked substantially at room temperature, is compressed to 800 kPa by the rotation of the screw and the temperature of the air becomes high due to adiabatic compression when the air is discharged. In some models, the temperature of air reaches high temperature of about 400° C. For this reason, the temperature of the rotor and the temperature of the inner portion of the casing rise up to a temperature substantially equal to the temperature of the compressed air, and the outer portion of the casing is heated with a temperature rise if nothing is performed. Accordingly, since the casing is provided with a flow passage (jacket) for cooling, fluid, such as coolant or oil, flows in the flow passage according to the model of the compressor to cool the compressor from the outside so that the temperature of the compressor is suppressed below 60 to 80° C.

When the operation of the compressor is stopped, high-temperature compressed air is cooled in the compressor and moisture contained in the air is condensed. Accordingly, moisture is attached to the inner portion of the compressor and the surface of an air flow passage. For this reason, since the suction-side casing and the discharge-side casing include portions where metal as a base material is exposed as it is, rust is generated on the portions. When the generated rust gradually spreads and grows and flakes of the generated rust enter the compressor, galling occurs during the operation of the compressor. When the galling further deteriorates, the rotors stick to each other and the breakdown of the compressor is caused.

In addition, since a demand for a high maintenance-free property of the oil-free screw compressor has been increased in recent years, measures against rust are further required. For this reason, a corrosion-resistant film having higher rust preventive effect needs to be formed on the surface of the casing.

However, the casing of a certain model of the compressor is a heavy member of which the weight exceeds 100 kg, and has a very complicated structure including a jacket that is used to cool the compressor from the outside, portions to which rolling bearings rotatably supporting the rotors are fitted, and the like in addition to the compression chamber that stores the rotors. For this reason, like a film-forming treatment or plating, a treatment for immersing the casing in reaction liquid is not easy when a pretreatment, a cleaning process, and taking the casing in and out of the liquid are considered. Accordingly, in the related art, a lubricant containing a rust-preventive pigment has been sprayed onto the inner portion of the casing and the outer surface of the casing has been separately coated with paint. For this reason, there are problems in that the rust prevention is insufficient at a boundary portion between the inner portion of the casing and the outer surface of the casing and labor hours are taken for the coating of the outer surface of the casing.

An object of the invention is to provide a compressor that includes a corrosion-resistant film formed on the surface of a casing having a complicated shape.

Solutions to Problems

For example, a structure disclosed in claims is employed to solve the above-mentioned problems. The invention includes plural pieces of means for solving the above-mentioned problems, but one example of the means is a compressor that pumps gas in a compression chamber formed by a casing. The casing is made of cast iron, and a layer made of a mixture of iron nitride and a compound of iron, nitrogen, and carbon and an oxide layer made of triiron tetraoxide are formed on the surface of the casing.

Effects of the Invention

According to the invention, since the corrosion resistance of the casing is improved, the generation of rust is suppressed. Accordingly, it is possible to provide a compressor in which galling or sticking caused by rust occurs less.

BRIEF DESCRIPTION OF THE DRAWINGS

FIG. 5 is a schematic diagram of films that are formed by a gas soft-nitriding treatment and an oxidation treatment of a first embodiment.

FIGS. 6A, 6B, and 6C are a schematic diagram illustrating a gas soft-nitriding film growth process of a graphite portion of a second embodiment.

FIG. 7 is a photograph of the section of a film of the second embodiment.

MODES FOR CARRYING OUT THE INVENTION

Embodiments of the invention will be described below with reference to the drawings, and the structure of a general oil-free screw compressor will be described first using the drawings.

Figure 1:
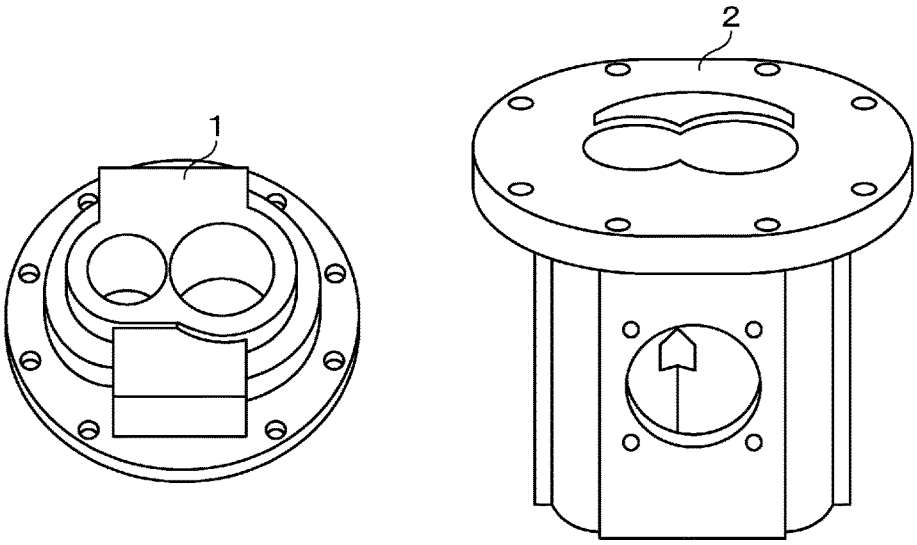
FIG. 1 is a perspective view of a suction-side casing and a discharge-side casing of an oil-free screw compressor.
Figure 2:
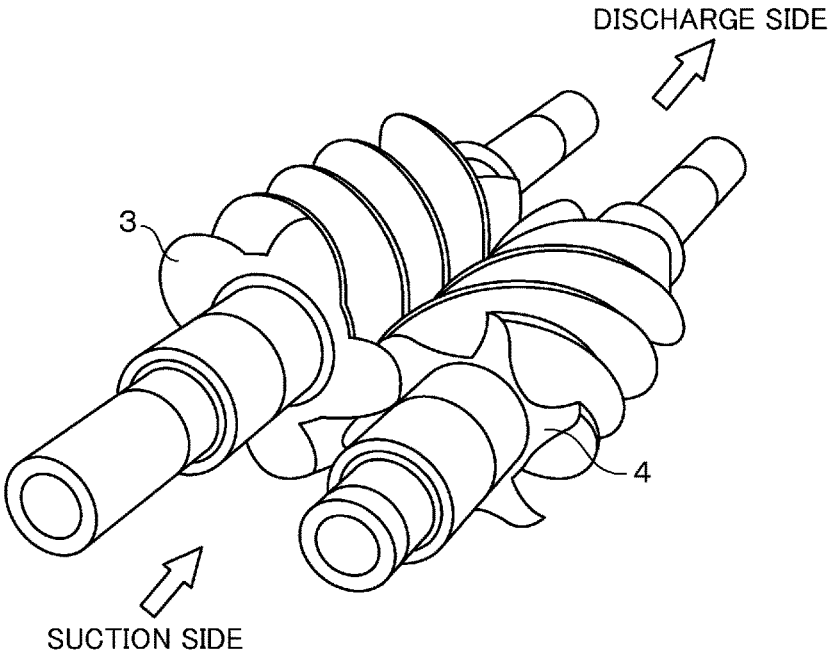
FIG. 2 is a perspective view of a male rotor and a female rotor of the oil-free screw compressor.

A screw compressor is adapted so that two rotors, that is, a male rotor 3 and a female rotor 4 illustrated in FIG. 2 compress air by meshing with each other and rotating. The male rotor 3 rotates in a clockwise direction when viewed from a suction side, and the female rotor 4 rotates in a counterclockwise direction when viewed from the suction side. The male and female rotors 3 and 4 are stored in a compression chamber that is formed by a discharge-side casing 2 and a suction-side casing 1 illustrated in FIG. 1.

Figure 3:
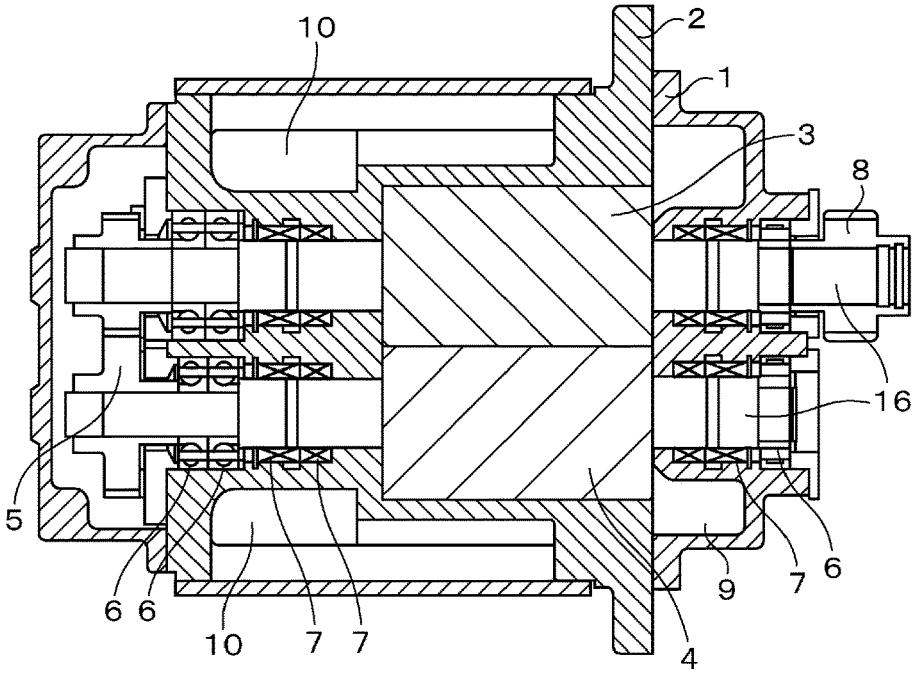
FIG. 3 is a cross-sectional view of a body of the oil-free screw compressor.

FIG. 3 is a cross-sectional view of a body of the oil-free screw compressor. In FIG. 3, both end portions of the male and female rotors 3 and 4, which mesh with each other, are rotatably supported by rolling bearings 6 provided on rotor shafts 16, and the leakage of air from the compression chamber is suppressed by shaft sealing devices 7 provided on the rotor shafts 16. Further, the shaft sealing devices 7 prevent oil, which has lubricated the rolling bearings 6, from entering the compression chamber that is formed by the discharge-side casing 2 and the male and female rotors 3 and 4. The spray of, for example, oil for cooling the pair of male and female rotors 3 and 4 and the like is not performed in the compression chamber. Gaps between the rotor shafts, which rotatably support the male and female rotors 3 and 4, and the compression chamber, which are formed by the discharge-side casing 2 and the male and female rotors 3 and 4, are sealed by the shaft sealing devices 7.

Furthermore, a drive pinion 8 is fixed to one end portion of the male rotor 3, and a pair of timing gears 5 is fixed to the other end portion of the male rotor 3 and the other end portion of the female rotor 4. The timing gears 5 are provided to transmit rotation between both the rotors 3 and 4 and to maintain rotational phases. Accordingly, when the drive pinion is driven, the pair of male and female rotors 3 and 4 is synchronously rotated by the pair of timing gears 5 and convex portions of the male rotor 3 and concave portions of the female rotor 4 mesh with each other in a non-contact manner. As a result, the male and female rotors 3 and 4 compress air, which is sucked from a suction port 9, and discharge the compressed air. Further, since the discharge-side casing 2 is provided with a jacket 10 that is a flow passage for cooling, fluid flows in the jacket to cool the compressor from the outside.

Figure 4:
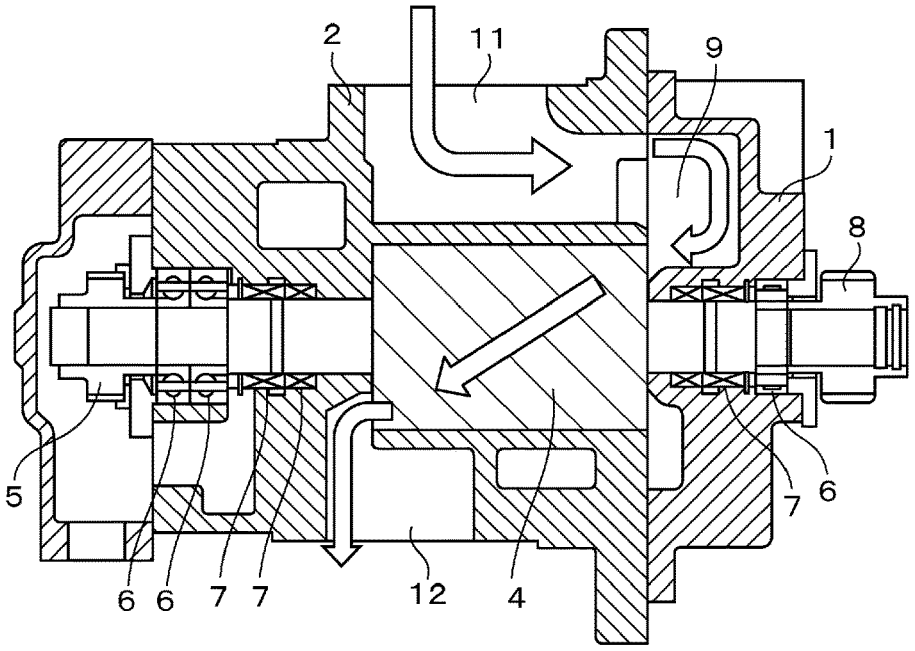
FIG. 4 is a longitudinal sectional view of the body of the oil-free screw compressor.

FIG. 4 is a longitudinal sectional view of the body of the oil-free screw compressor. Arrows illustrated in FIG. 4 represent the flow of air. In FIG. 4, air, which is sucked from the upper surface of the discharge-side casing 2, is introduced into the compression chamber from a suction chamber 11, which is provided in the discharge-side casing 2, through the suction port 9 of the suction-side casing 1. After that, air, which is compressed by the male and female rotors 3 and 4, is discharged to the outside of the compression chamber from a discharge port, which is a portion through which compressed air comes out, and a discharge chamber 12.

The casings illustrated in FIG. 1 will be described in detail below. The discharge-side casing 2 includes: the compression chamber that stores the male and female rotors 3 and 4, the suction chamber 11 and the discharge chamber 12 in which air to be compressed flows, the rolling bearings 6 that support the male and female rotors 3 and 4, the shaft sealing devices 7 that prevent lubricating oil, which is to be sucked into the bearings, from entering the compression chamber; and the jacket 10 in which a medium cooling the casing flows. Further, the suction-side casing 1 includes the rolling bearings 6 that support the male and female rotors 3 and 4, and the shaft sealing devices 7 that prevent lubricating oil, which is to be supplied to the bearings, from entering the compression chamber.

These casings are produced by the following steps. First, a material is poured into a mold so as to be cast in the mold having a shape close to the final shape. Next, annealing for eliminating internal stresses is performed. Further, rough cutting and precise machining are performed to machine the material into the shape of the casing. Meanwhile, since having complicated structures, inner portions of the suction chamber 11, the discharge chamber 12, and the jacket 10 cannot be subjected to machining and casting surfaces remain thereon. A portion of the casting surface, which is not subjected to machining, is also present on other outer peripheral surfaces. Since the surface of a casting, which is cast in a sand mold, has unevenness on the order of millimeters, the uneven portion forms a liquid pool and condensed water is likely to stay. For this reason, rust is more easily generated. In particular, the inner portion of the jacket or a portion of the casting surface of the discharge chamber is a portion on which rust is easily generated.

There is also a problem in that the casing includes both the machined surface and the casting surface as described above. Hereinafter, both the casting surface and the machined surface are referred to as the entire surface of the casing.

Further, there are two kinds of screw compressors, that is, a two-stage screw compressor and a single-stage screw compressor. The two-stage screw compressor is a compressor in which two screw compressors are connected to each other in series through a pipe and a cooler; and is a compressor that cools high-temperature discharged gas, which is discharged from a first compressor, by the cooler, which uses outside air or water as a refrigerant and then compresses the cooled discharged gas again by a second compressor. Accordingly, since the temperature of the discharged gas is lowered once, the temperature of a gas discharged from the second compressor can be lowered. However, while compressed air is cooled in the two-stage screw compressor, condensed water is generated. Since a part of the condensed water is brought into the second compressor, rust is particularly easily generated.

First Embodiment

A structure in which a corrosion-resistant film is formed on the surface of the casing by a gas soft-nitriding treatment will be described in this embodiment.

First, a gas soft-nitriding treatment and an oxidation treatment employed in this embodiment will be described. Generally, a gas nitriding treatment is known as a surface-hardening treatment that forms a nitrided layer by diffusing nitrogen into iron. A gas nitriding treatment is a treatment that is used to form compounds of Al, Cr, Mo, and the like, iron, and nitrogen, and is a treatment that can be applied to high-grade steel including Al, Cr, and Mo.

In contrast, a gas soft-nitriding treatment employed in this embodiment is a treatment that is used to form a nitrided layer by diffusing nitrogen into iron likewise, but is a treatment that can be applied to low-grade steel such as carbon steel or cast iron. Accordingly, a gas soft-nitriding treatment is distinguished from a gas nitriding treatment.

A method of performing a gas soft-nitriding treatment includes disposing an object in a treatment furnace, injecting an ammonia gas and a carburizing gas into the treatment furnace, heating the object, and keeping the object according to a reaction time. Accordingly, a layer ($Fe_{2-3}(N,C)+Fe_4N$) made of a mixture of iron nitride and a compound of iron, nitrogen, and carbon is formed. This layer is a gas soft-nitrided layer.

After the gas soft-nitriding treatment, the object is kept in high-temperature air so as to be subjected to an oxidation treatment. Accordingly, an iron oxide layer is formed on the surface of the object. The oxidation treatment is performed in another oxidation furnace after the gas soft-nitriding treatment, but may be continuously performed by facilities. Since an oxide layer made of triiron tetraoxide ($Fe_3O_4$) is formed on the surface of the object by the oxidation treatment, the corrosion resistance of the object can be improved.

FIG. 5 is a schematic diagram of films that are formed by the gas soft-nitriding treatment and the oxidation treatment. Since gas soft nitriding forms a nitrided layer while nitrogen is diffused into iron as illustrated in FIG. 5, a film grows both toward the upper side of the surface and toward a base material, which is provided on the lower side, from a dimension that is obtained before the treatment. Accordingly, the thickness of a film, which includes the gas soft-nitrided layer and an oxidized layer (oxide layer), is generally larger than the actual variation of a dimension changing from the dimension that is obtained before the treatment. A treatment in which the actual variation of a dimension is smaller than the thickness of the film is suitable as a treatment that is to be applied to a component, such as a casing, of which the dimension needs to be managed. The thickness of the film can be controlled by treatment conditions, that is, temperature and time, but is basically increased with an increase of the treatment time.

Meanwhile, in this embodiment and subsequent embodiments, assuming that the thickness of the oxidized layer is smaller than the thickness of the gas soft-nitrided layer, it is regarded that the thickness of the oxidized layer is negligible. Accordingly, when there is not a particular denial, the thickness of the film including the gas soft-nitrided layer and the oxidized layer is described as the thickness of the gas soft-nitrided layer. However, when the thickness of the oxidized layer is large so as not to be negligible, the thickness of the gas soft-nitrided layer can be replaced with the thickness of the film including the gas soft-nitrided layer and the oxidized layer.

According to this embodiment, the corrosion resistance of the suction-side casing and the discharge-side casing, which include a film formed by the gas soft-nitriding treatment and the oxidation treatment as described above, is improved. Accordingly, since the generation of rust is suppressed, it is possible to provide a compressor in which galling or sticking caused by rust occurs less. Further, since the gas soft-nitriding treatment is performed, a corrosion-resistant film can be formed on the entire surface of a casing having a complicated structure. Accordingly, since rust prevention can be performed on a boundary portion, of which rust prevention has been insufficient in the related art, between the inner portion of the casing and the outer surface of the casing, the reliability of the compressor is improved by the suppression of the generation of rust. Furthermore, the coating of the outer surface of the casing, which has been needed in the related art, is also not needed.

Second Embodiment

When a treatment is performed on the entire surface of the casing having a complicated structure, a treatment using a gas is effective as in the first embodiment. However, since the surface of the casing becomes rough in a certain type of treatment, the application of the certain type of treatment to a precise component requiring a dimensional accuracy needs to be considered. Particularly, since rolling bearings, which support rotor shafts, are fitted to the casing, there is a problem in that the conditions of dimensional tolerances of portions to which the rolling bearings are fitted are strict. In this embodiment, a corrosion-resistant film, which is formed on the surface of the casing in consideration of these conditions of dimensional tolerances, will be described.

First, the influence of graphite, which is present in cast iron forming the casing, on the formation of a nitrided layer will be described. FIG. 6 is a schematic diagram illustrating a gas soft-nitriding film growth process of a graphite portion. In FIG. 6, reference numeral 13 denotes graphite and reference numeral 14 denotes a gas soft-nitrided layer. A film grows along graphite at portions in which graphite is present in the surface of cast iron in order of (A), (B), and (C) as illustrated in FIG. 6. This is because a gas enters a gap between graphite and iron and soft nitriding proceeds, and the growth of a film is significantly affected by the size and distribution of flake-like graphite in the case of cast iron including elongated flake-like graphite.

FIG. 7 illustrates a photograph of the section of an actual film. A white portion on the lower side in FIG. 7 is cast iron that is a base material, and flake-like black portions in the white portion are graphite. Further, a black portion on the upper side in FIG. 7 is originally a space but is shown as a black since a resin is solidified for measurement. Furthermore, since it is difficult to recognize a film portion, a boundary line between the film and the base material is shown by a dotted line. It is possible to confirm that a large difference is generated between the thickness of the film at a portion in which flake-like graphite is present and the thickness of the film at a portion in which flake-like graphite is not present as illustrated in FIG. 7 and protrusion-shaped projections are also formed on the surface.

Since a film grows along graphite to a deep position with an increase of the treatment time, a local difference in the thickness of the film is further increased. Particularly, when graphite is present from the surface of the film in a vertical direction, the thickness of the film is further increased and embossments like protrusions are formed on the surface of the film. Since the shape, size, and distribution of graphite, which affect the surface roughness as described above, are determined according to the conditions that are obtained when a material is cast in a mold, the shape, size, and distribution of graphite cannot be controlled.

Since the thickness of a film, which is formed on cast iron by a gas soft-nitriding treatment, is not constant due to an influence of flake-like graphite as described above, the thickness of the film in this embodiment is defined as described below. That is, the thickness of the film is evaluated by the thickness of the film that grows at a portion made of only iron not affected by graphite. Specifically, as illustrated in FIGS. 6(C) and 7, the thinnest film portion of a portion in which graphite is not present is referred to as the thinnest portion 15, and the thickness of the thinnest portion 15 is defined as the thickness of the film.

When a gas soft-nitriding treatment is performed to form a gas soft-nitrided layer on the casing made of cast iron as described above, the thickness of the gas soft-nitrided layer needs to be within a dimensional accuracy in consideration of surface roughness.

The dimensional tolerance conditions of a portion, to which the rolling bearing holding the rotor shaft is fitted, as a portion, which requires strict dimensional control, of a casing having a complicated shape are strict. For example, since the screw compressor has various sizes according to an output, the diameter of a hole of a bearing fitting portion close to the casing is in the range of ϕ40 mm to 140 mm. A dimensional tolerance in the dimensional range is in the range of about 25 μm to 40 μm. Accordingly, when the surface roughness of the hole portion, particularly, the height of the above-mentioned specific protrusion formed due to the presence of graphite is larger than a range of 12.5 to 20 μm (a half of the range of the dimensional tolerance in the radial direction), it is difficult to assembly the compressor. For this reason, the maximum height of the protrusion of the surface roughness needs to be set to 20 μm or less. Further, the surface roughness needs to be preferably set to 12.5 μm or less where all models can be assembled.

Figure 8:
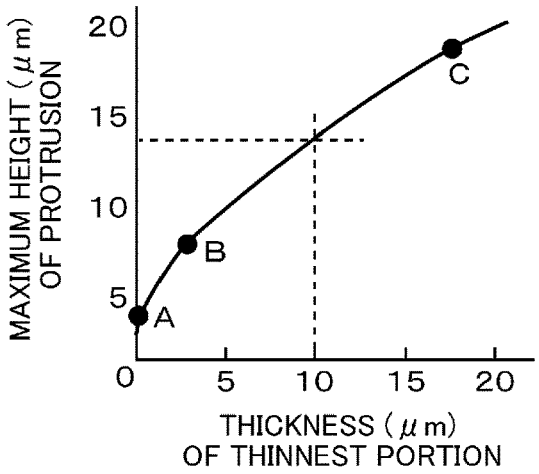
FIG. 8 is a graph illustrating a relationship between the thickness of the thinnest portion and the maximum height of a protrusion of the film of the second embodiment that includes a gas soft-nitrided layer and an oxidized layer.
Figure 9:
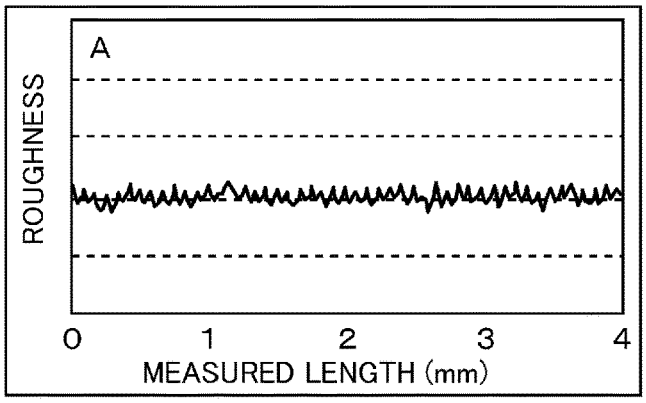
FIG. 9 is a diagram illustrating a part of surface roughness at a point A of FIG. 8.
Figure 10:
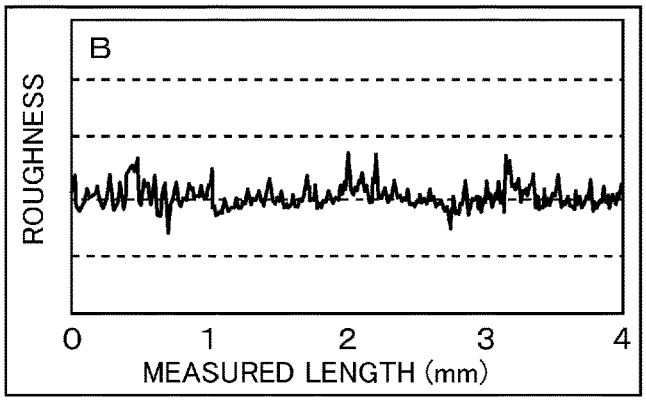
FIG. 10 is a diagram illustrating a part of surface roughness at a point B of FIG. 8.
Figure 11:
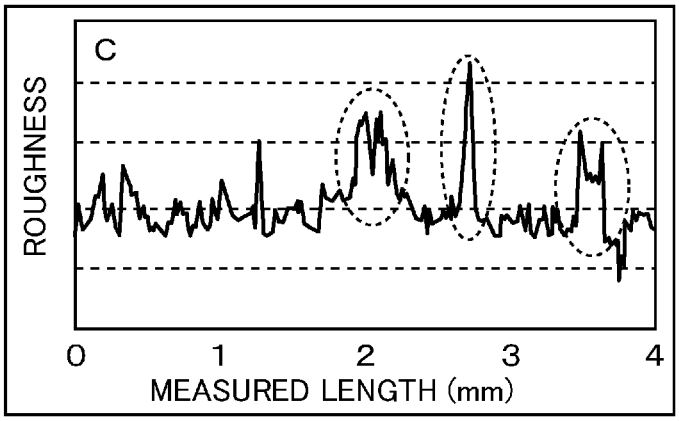
FIG. 11 is a diagram illustrating a part of surface roughness at a point C of FIG. 8.

FIG. 8 is a graph illustrating a relationship between the thickness of the thinnest portion and the maximum height of the protrusion of the film that includes the gas soft-nitrided layer and the oxidized layer. Furthermore, FIGS. 9, 10, and 11 are diagrams illustrating a part of surface roughness at a point A, a point B, and a point C of FIG. 8. It is understood that the height of the protrusion is increased with an increase of the thickness of the thinnest portion as illustrated in FIG. 8. The protrusions indicate, for example, portions that are surrounded by circles in FIG. 11. The protrusion indicates a portion where the gas soft-nitriding treatment grows along the above-mentioned flake-like graphite portion.

In order to set the maximum height of the protrusion of the surface roughness where the compressor is easily assembled to 20 μm or less as described above from necessity for determining the thickness of the film in consideration of the fitting of the bearing, it is necessary to set the thickness of the thinnest portion to 18 μm or less from the graph of FIG. 8. Further, it is understood that it is necessary to set the thickness of the thinnest portion to 10 μm or less from the graph of FIG. 8 in order to set the maximum height of the protrusion of the surface roughness, where all models can be assembled, to 12.5 μm or less.

Thus, according to this embodiment, it is possible to form a corrosion-resistant film, which is formed on the surface of a casing considering dimensional tolerance conditions by setting the thickness of the thinnest portion of the gas soft-nitrided layer to 18 μm or less, preferably, 10 μm or less.

Third Embodiment

A corrosion-resistant film, which is formed on the surface of a casing considering corrosion-resistant performance, will be described in this embodiment.

Figure 12:
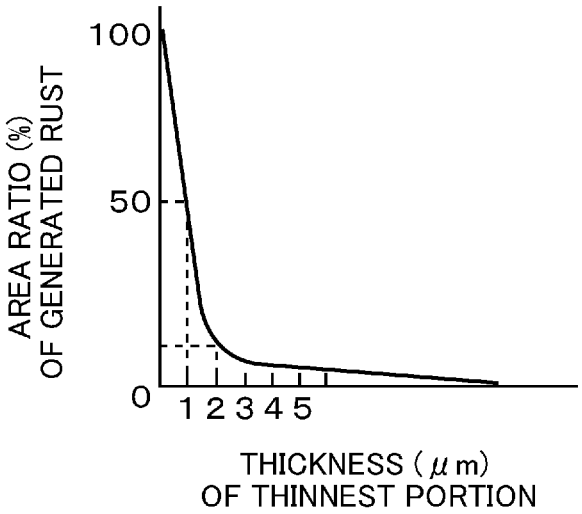
FIG. 12 is a graph illustrating a relationship between the thickness of the thinnest portion of a film of a third embodiment that includes a gas soft-nitrided layer and an oxidized layer and an area ratio of generated rust that represents corrosion-resistant performance.

FIG. 12 is a graph illustrating a relationship between the thickness of the thinnest portion of a film that includes a gas soft-nitrided layer and an oxidized layer and an area ratio of generated rust that represents corrosion-resistant performance. The corrosion-resistant performance is a state in which rust is generated on the surface of a specimen where a film is formed on the machined surface of cast iron by a gas soft-nitriding treatment and an oxidation treatment and which has been kept for 500 hours in the environment of a temperature of 60° C. and a humidity of 90%.

As illustrated in FIG. 12, rust was generated on substantially the entire surface of a cast iron base material (of which the thickness of a film is 0 μm), which was not subjected to a gas soft-nitriding treatment, in one hour. However, it was understood that a rate of generation of rust was reduced by 50% even through the cast iron base material was keep under high humidity for 500 hours when the thickness of the thinnest portion was 1 μm and a rate of generation of rust was reduced to 10% when the thickness of the thinnest portion was 2 μm. Further, the generation of rust was caused in first several hours and the amount of rust was then almost constant without increasing. Accordingly, rust did not proceed.

Rust is also generated on the entire surface of a portion, which is not subjected to a surface treatment, of an actual casing, rusty portions are missed from the surface, enter the compressor, and cause a trouble, such as galling. However, a rust preventive effect is significant even when a rate of generation of rust is reduced by 50%. Preferably, when a rate of generation of rust is 10% or less and rust does not proceed, a rust preventive effect is sufficient. Accordingly, the thickness of the thinnest portion of the gas soft-nitrided layer needs to be set to 1 μm or more, preferably, 2 μm or more.

Meanwhile, even in regard to the casting surface, a specimen, which was subjected to the same gas soft-nitriding treatment and the same oxidation treatment under a treatment condition where the thickness of the thinnest portion on the machined surface was 2 μm, was formed and a corrosion-resistant performance confirming test was performed. As a result, it was possible to confirm that the same corrosion-resistant performance was obtained.

Accordingly, according to this embodiment, it is possible to provide a casing, which has a rust preventive effect, by setting the thickness of the thinnest portion of the gas soft-nitrided layer to 1 μm or more, preferably, 2 μm or more.

From the above-mentioned second and third embodiments, it is possible to provide a film, which has a rust preventive effect and does not hinder the assembly of a compressor, by setting the thickness of a film, which is formed by a gas soft-nitriding treatment, in the range of 1 μm to 18 μm, preferably, in the range of 2 μm to 10 μm.

Meanwhile, an object of a treatment in this time is cast iron. Cast iron indicates general castings made of iron that contains carbon in the range of 2 to 8% and silicon in the range of 1 to 3%, but is classified into several types according to the state of carbon. Gray cast iron (flake-like-graphite cast iron) containing elongated graphite is used in this embodiment, but other cast iron containing the same elongated graphite can be applied since other cast iron containing the same elongated graphite also causes the same phenomenon. That is, gray cast iron (flake-like-graphite cast iron), CV cast iron, or spheroidal graphite cast iron can also be applied as cast iron partially containing flake-like graphite.

Further, a screw type compressor has been used in the embodiments as the type of the compressor, but the type of the compressor is not limited thereto. As long as a compressor pumps gas in a compression chamber formed by a casing, the casing is made of cast iron, and requires a surface treatment, the compressor may be a reciprocating compressor, a scroll compressor, or the like.

The embodiments have been described above, but the invention is not limited to the above-mentioned embodiments and includes various modifications. For example, the above-mentioned embodiments have been described in detail for easy understanding of the invention, and the invention is not limited to a compressor that necessarily includes all components having been described above. Further, a part of components of a certain embodiment can be replaced with components of another embodiment, and components of another embodiment can also be added to the components of a certain embodiment. Furthermore, other components can also be added to, be removed from, and replace a part of components of each embodiment.

The invention claimed is:

1. A compressor that pumps gas in a compression chamber formed by a casing, wherein the casing including a portion of the casing that forms the compression chamber is made of cast iron, and a layer made of a mixture of iron nitride and a compound of iron, nitrogen, and carbon and an oxide layer made of triiron tetraoxide are formed on the surface of the casing.

2. The compressor according to claim 1, wherein the layer made of the mixture and the oxide layer are formed on the entire surface of the casing.

3. The compressor according to claim 1, wherein the compressor is an oil-free compressor that pumps gas by the rotational motion of a rotor, the reciprocating motion of a piston, or the turning motion of a spiral tooth-shaped member in the compression chamber formed by the casing.

4. An oil-free screw compressor that includes a male rotor including teeth formed in a helical shape on an outer surface thereof in an axial direction, a female rotor meshing with the male rotor and rotating, and a casing storing the male rotor and the female rotor, and sucks and discharges fluid, wherein the casing including a portion of the casing that forms the compression chamber is made of cast iron, and includes a film that is formed on the surface of a flow passage, with which a compressed medium comes into contact, by a gas soft-nitriding treatment and an oxidation treatment, and the thickness of the film is in the range of 1 μm to 18 μm.

5. The oil-free screw compressor according to claim 4, wherein the thickness of the film is in the range of 2 μm to 10 μm.

6. The oil-free screw compressor according to claim 4, further comprising:

rolling bearings that rotatably support the male rotor and the female rotor in the casing.

7. The oil-free screw compressor according to claim 5, further comprising:

rolling bearings that rotatably support the male rotor and the female rotor in the casing.

8. A method of manufacturing a casing used for a compressor that pumps gas in a compression chamber formed by the casing, disposing, the casing including a portion of the casing that forms the compression chamber which is made of cast iron, in a treatment furnace;

injecting an ammonia gas and a carburizing gas into the treatment furnace and heating the casing;

forming a gas soft-nitrided layer on the surface of the casing by keeping the casing for a predetermined time; and forming an iron oxide layer on the gas soft-nitrided layer by keeping the casing in high-temperature air to perform an oxidation treatment.

* * * * *